US005833184A

United States Patent [19]

Scola

[11] Patent Number: 5,833,184

[45] Date of Patent: Nov. 10, 1998

[54] CLOTHES HANGER CARRYING DEVICE

[76] Inventor: Vito A. Scola, 150 Apple Gate Rd., Cranston, R.I. 02920

[21] Appl. No.: 7,873

[22] Filed: Jan. 15, 1998

[51] Int. Cl.[6] ..... F16M 11/00

[52] U.S. Cl. ..... 248/176.1; 211/49.1

[58] Field of Search ..... 248/176.1; 211/49.1, 211/59.1; 206/300; 223/85

[56] References Cited

U.S. PATENT DOCUMENTS

| | | | |
|---|---|---|---|
| 268,130 | 11/1882 | Roberts | 211/49.1 |
| 2,530,609 | 11/1950 | Friedman | 211/49.1 |
| 2,609,919 | 9/1952 | Lee | 211/49.1 |
| 2,853,196 | 9/1958 | Drake | 211/59.1 |
| 2,918,174 | 12/1959 | Tabbi | 211/49.1 |
| 3,021,010 | 2/1962 | McMasters | 211/49.1 |
| 3,115,968 | 12/1963 | Peterson | 211/49.1 |
| 3,127,018 | 3/1964 | McMasters | 211/59.1 |
| 3,139,986 | 7/1964 | Strock | 211/59.1 |
| 3,357,544 | 12/1967 | Gingher | 206/300 |
| 3,490,599 | 1/1970 | Von Maur, Jr. | 211/49.1 |
| 3,692,188 | 9/1972 | Bayne | 211/59.4 |
| 4,016,981 | 4/1977 | Hidlt | 211/49.1 |
| 4,768,658 | 9/1988 | Shafto | 211/59.1 |

*Primary Examiner*—Leslie A. Braun
*Assistant Examiner*—Robert Lipcsik
*Attorney, Agent, or Firm*—Salter & Michaelson

[57] ABSTRACT

A clothes hanger carrying device for neatly stacking and storing a plurality of the conventional wire type clothes hangers includes a bottom base flange having a greater perimeter than the triangular body of the clothes hanger to provide a support for a plurality of the hangers. A stacking body extends upwardly from the base flange and has a perimeter smaller than the triangular body of the clothes hanger so that a plurality of the hangers may be stacked thereover. The stacking body has three side edges each of which is slightly angled outwardly from top to bottom so that a plurality of the carrying devices may be nested together. The device further includes an integral handle which extends upwardly from a top wall thereof for convenient transportation of the device.

6 Claims, 4 Drawing Sheets

CLOTHES HANGER CARRYING DEVICE

BACKGROUND AND SUMMARY OF INVENTION

This invention relates generally to wire and/or plastic clothing hangers, and more particularly, to a clothes hanger carrying device which is effective for neatly stacking, storing, and carrying a plurality of clothing hangers.

Clothing hanger receptacle devices are generally well known in the prior art. In this regard, the U.S. Patents to A. Friedman U.S. Pat. No. 2,530,609; Shafto U.S. Pat. No. 4,768,658; G. Tabbi U.S. Pat. No. 2,918,174; and Bayne U.S. Pat. No. 3,692,188 are the closest prior art to the subject matter of the instant invention of which the applicant is aware.

In the dry cleaning business, retail clothing business, or any other industry which uses large amounts of clothing hangers, as well as in homes, it is important to have some kind of stacking or storage receptacle where the hangers may be kept while not being used so that they may be easily transported and/or accessible for re-use. One method of storing the used hangers is to throw them into an empty carton or storage box. However, this usually results in a disorganized mess of tangled hangers which are difficult to access. The instant invention is directed to a carrying device that is designed to overcome the disadvantages associated with previous methods of storing and transporting clothes hangers. The carrying device of the instant invention is constructed in such a manner that the hook portions of the hangers all face in the same direction when the hangers are stacked around the body of the carrying device. This provides for a device which neatly receives a plurality of unused hangers that may be easily accessed for reuse of same.

The instant invention is directed to a carrying device for hangers of the type used for hanging clothes. The carrying device enables a plurality of clothing hangers to be neatly stacked therearound for better storage and more convenient transportation of a plurality of clothing hangers. The carrying device includes a base flange which extends around the bottom perimeter thereof upon which the bottommost hanger rests. A body portion extends upwardly from the base flange over which a plurality of the clothing hangers may be stacked. Both the base flange and body portion have a generally triangular shape, the body portion including three side walls which meet at three side edges thereof, with each of the three side edges being slightly tapered or angled inwardly from bottom to top so as to enable a plurality of the carrying devices to be placed in a stacking or nesting relation for saving space when the devices are shipped or stored prior to use. The carrying device further includes a top wall having an integral handle extending upwardly therefrom for easy and convenient transportation of the carrying device.

Accordingly, among the several objects of the instant invention are: the provision of a carrying device which provides efficient storage and convenient transportation for a plurality of clothing hangers; the provision of a carrying device which enables a plurality of clothing hangers to be neatly stacked for easy access and re-use of the clothing hangers; the provision of a carrying device wherein the hook portion of the clothing hangers all face in the same direction when the hangers are stacked therearound; the provision of a carrying device having a body portion over which a plurality of hangers may be stacked; the provision of a carrying device having slightly angled side edges enabling the devices to be nested within one another for efficient storage and transportation of a plurality of said carrying devices; the provision of a carrying device having a base flange extending outwardly from the bottom edge of said body portion for supporting the stacking of a plurality of the clothes hangers; the provision of a carrying device having a handle extending upwardly from its top wall for convenient transportation of the carrying device; the provision of a carrying device that is fabricated from a light weight plastic material; the provision of a carrying device that is simple and easy to use; and the provision of a carrying device that is cost efficient and easy to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
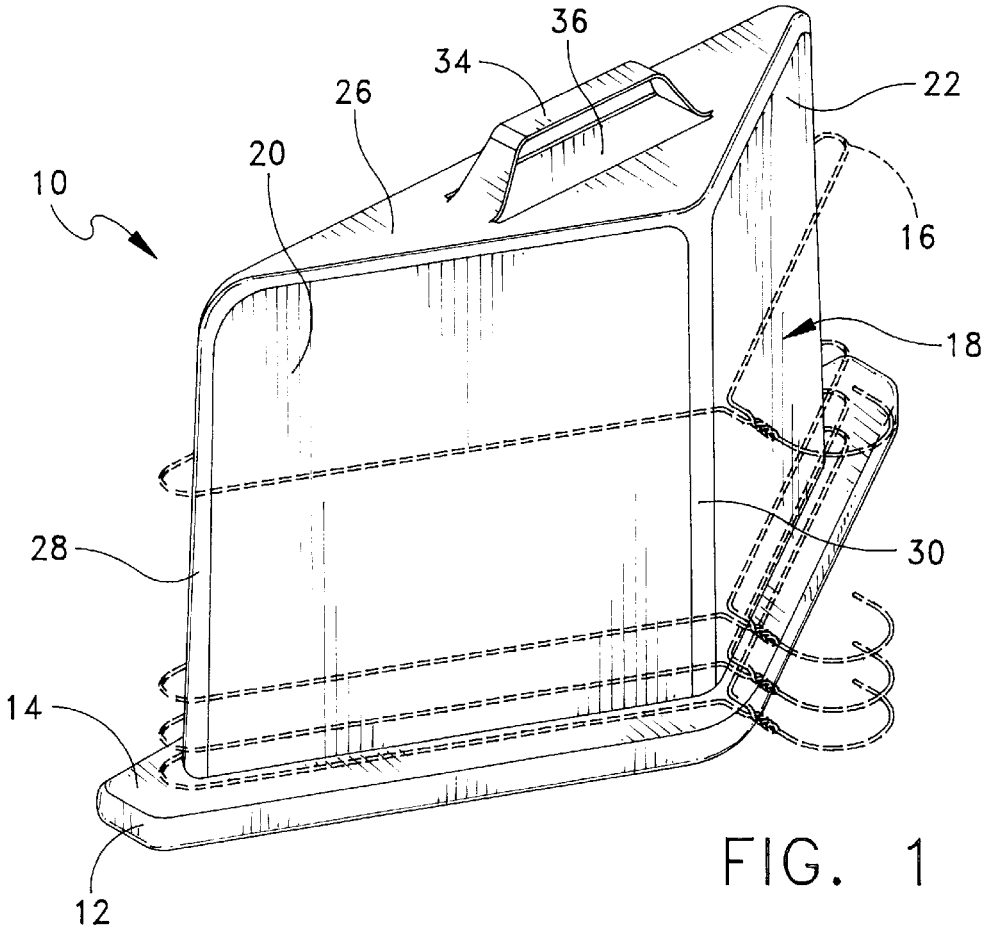
FIG. 1 is a perspective view showing the carrying device of the instant invention with a plurality of hangers, shown in broken lines, stacked thereover.
Figure 2:
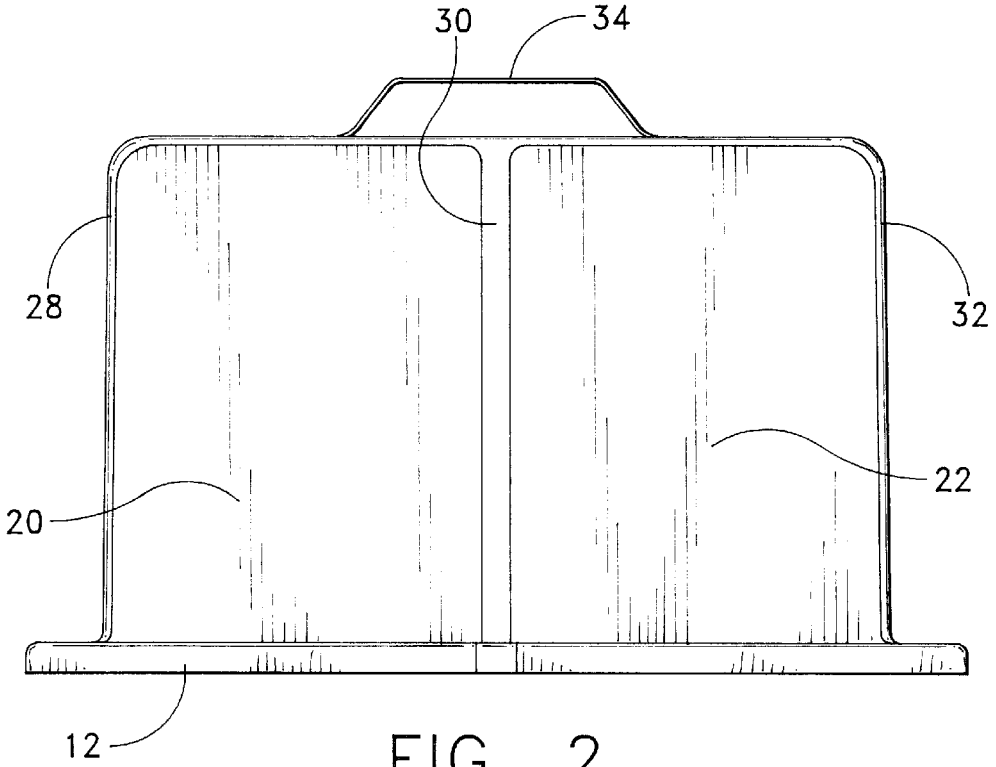
FIG. 2 is a front view thereof.

Referring now to the drawings, and more particularly to FIG. 1, the clothes hanger carrying device of the instant invention is shown and generally indicated at 10.

As will hereinafter be more fully described, the instant invention provides for a carrying device that is effective for stacking a plurality of clothing hangers in a neat orderly fashion with the hook portion of the clothes hangers all facing in the same direction. The device includes an integrally formed handle extending from the top portion thereof which enables the device to be conveniently transported from one place to another. The device is a boon for people in the retail clothing and dry cleaning industries, but is also very useful in the residential environment for stacking, storage, and transportation purposes as well.

Figure 6:
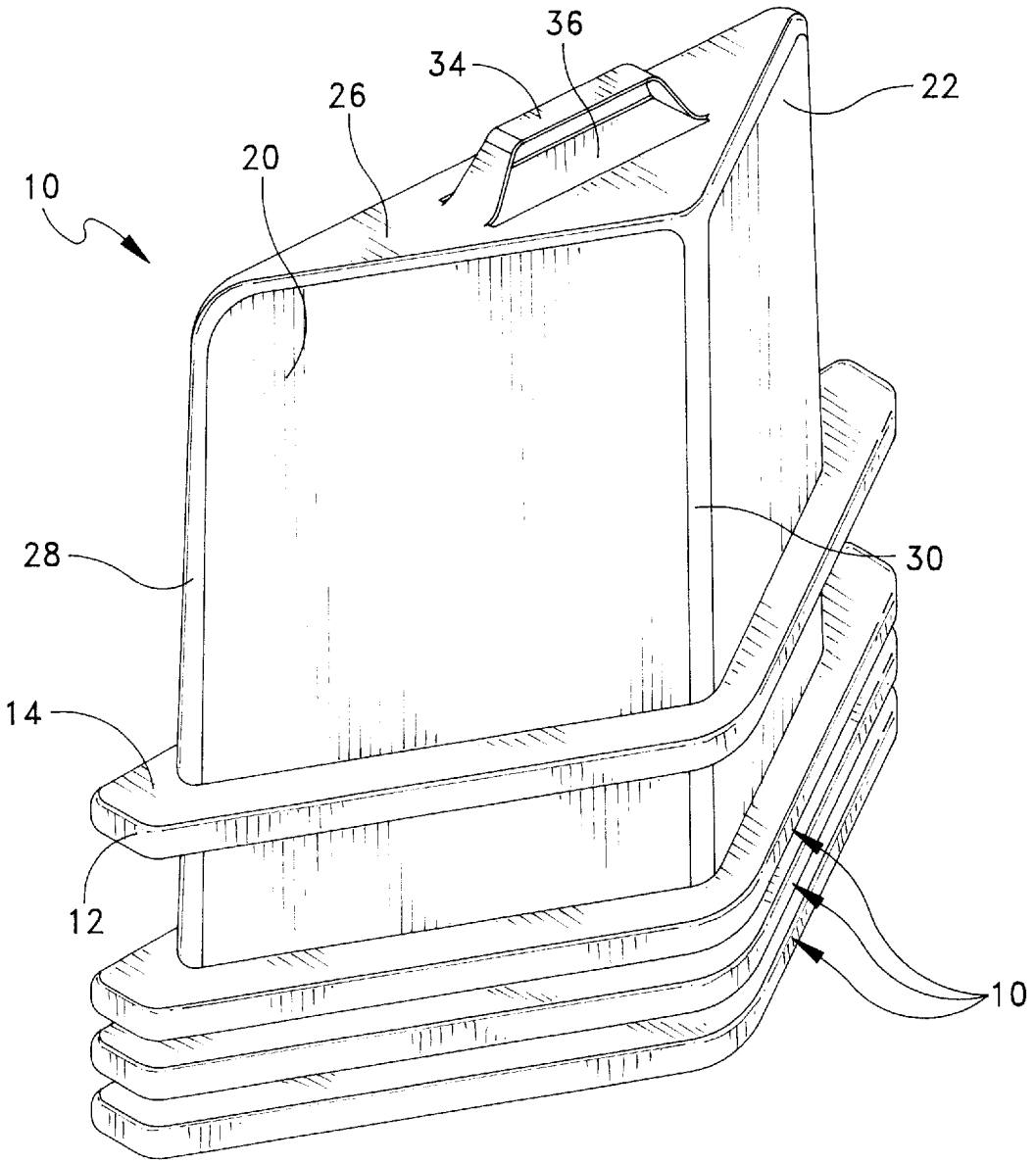
FIG. 6 is a perspective view showing a plurality of the carrying devices of the instant invention in a nested stacking relation.

Referring to FIG. 1, the clothes hanger carrying device 10 includes a base flange 12 which extends around the bottom perimeter of the device 10. The base flange 12 has a top surface 14 over which the body of the plurality of stacked hangers rest. As shown in the drawing, the base flange provides support means on which a plurality of hangers 16, shown in broken lines in FIG. 1 may rest, it being understood that in actual use, the hangers will lie one on top of the other in tightly stacked relation. As will be noted, flange 12 extends outwardly from body portion 18 a substantial distance, i.e., at least one inch, so as to provide a sufficient base for receiving the hangers, and at the same time, accommodating slightly oversize hangers. Extending upwardly from the base flange 12 of the carrying device 10 is a body portion 18 over which a plurality of the hangers 16 may be stacked. The body portion 18 has a generally triangular shape so as to generally conform to the shape of the hangers, which includes three side walls 20, 22, and 24 and a top wall 26. The triangular configuration of body portion 18 is dimensioned so as to be somewhat smaller than a conventional hanger so that the latter can fit freely thereover, and so as to accommodate slightly undersize hangers. The side walls 20, 22, and 24 of the body portion 18 meet at side edges 28, 30, and 32 each of which are slightly angled outwardly from top to bottom so that a plurality of the carrying devices 10 may be stacked in a nesting relationship as shown in FIG. 6. The top wall 26 of the carrying device 10 further includes an integral handle member 34 which extends upwardly therefrom so that the device 10 may be easily transported from one place to another. The top wall 26 has an opening 36 from which the handle 34 is formed, said opening also permitting the handle to be more comfortably gripped by the users hand.

Figure 3:
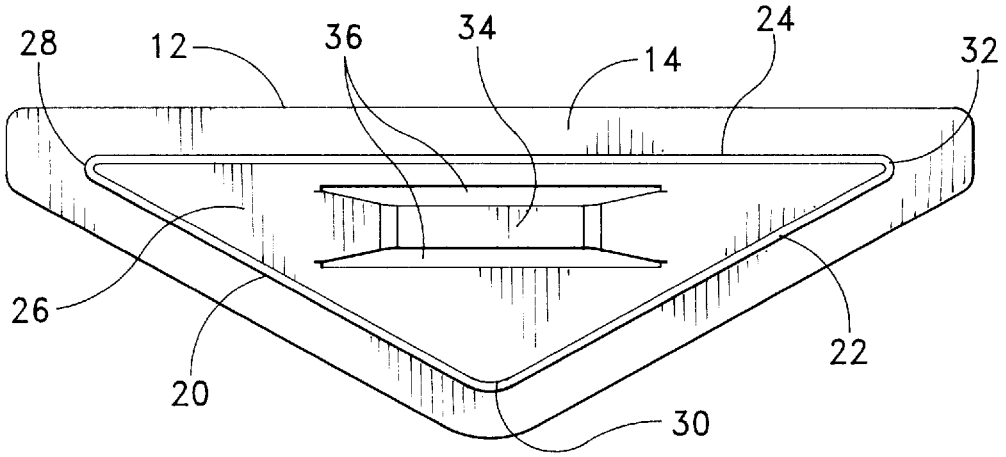
FIG. 3 is a top view thereof.
Figure 4:
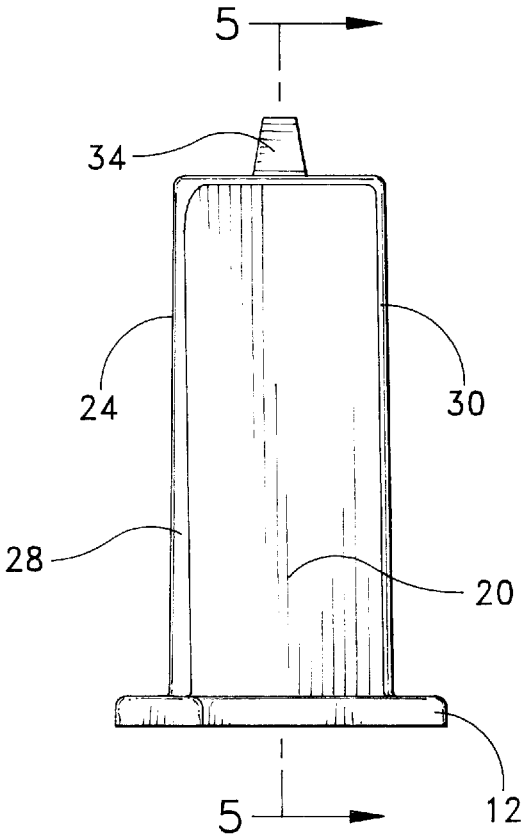
FIG. 4 is a side view thereof.

Referring now to FIGS. 2–5, the generally triangular shape of the carrying device 10 of the instant invention is most clearly shown in FIG. 3. It should be noted from FIGS. 2–4, that the edges of the stacking body 18 and the base flange 12 of the carrying device are rounded so as to eliminate sharp corners and provide a softer overall appearance. Side edges 28–32 are slightly angled outwardly from top to bottom so as to enable a plurality of the carrying devices 10 to be placed in nesting relation with one another during shipment and storage as shown in FIG. 6. Further, the angled side edges 28–32 of the instant invention 10 allow the device to be more easily removed from its mold. In this connection, since the carrying device of the instant invention is preferably made from an injection molding process, the angled edges enable the finished device to be more easily removed from the mold.

Figure 5:
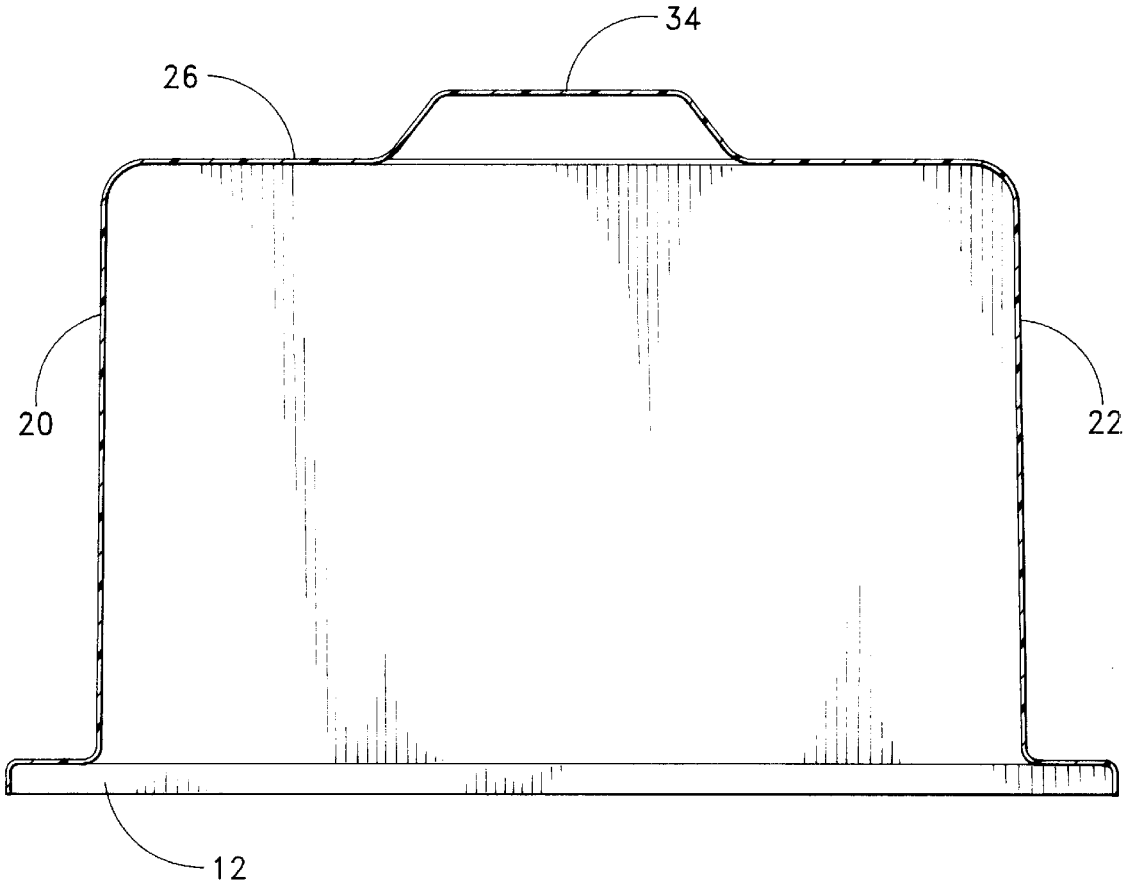
FIG. 5 is a cross-sectional view taken along line 5—5 of FIG. 4.

Referring now to FIG. 5, it is readily apparent that the carrying device 10 of the instant invention is a one-piece integral unit. Specifically, the carrying device is preferably fabricated from a light-weight but durable plastic material formed through the injection molding process discussed above. The weight of carrying device 10 is further reduced because the molding operation results in a hollow configuration.

In use, used or unused hangers 16 may be stacked over the body portion 18 of the carrying device 10 in the manner depicted in FIG. 1. Specifically, the neck portion of each hanger 16, from which the hook portion extends, abuts the front edge 30 of the carrying device 10 when the hangers 16 are placed in stacking relation thereover. More specifically, the bottommost hanger 16 rests on the top surface 14 of base flange 12 which provides a support for a plurality of the stacked hangers. In this connection, approximately fifty hangers may be stacked over the body portion 18 of the device 10 before the hangers begin to reach a height higher than the body portion 18 and spill thereover. It has been found that, if the height of the body portion is approximately 8½ inches, 50 hangers can be accommodated.

It can therefore be seen that the instant invention provides for a clothes hanger carrying and storage device that is effective for stacking a plurality of clothes hangers in a neat orderly fashion with the hook portion of the clothes hangers all facing in the same direction. The device is particularly effective for people in the retail clothing and dry cleaning industries, but is also effective for individual residential use as well. The device includes a handle which extends upwardly from the top portion thereof for convenient transportation of a plurality hangers stacked around the body of the carrying device. The side edges of the body of the carrying device are slightly angled outwardly from top to bottom so that a plurality of the devices may be nested together for neat storage and easy transportation of the devices. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A clothes hanger carrying device comprising:

a bottom base flange having a generally triangular shape which is adapted to be conformed to the shape of a conventional wire type clothes hanger and adapted to have a slightly greater perimeter than the triangular body of said clothes hanger so as to provide a support for a plurality of said hangers when they are placed in a stacking relation over the carrying device;

a stacking body extending upwardly from said base flange and recessed inwardly from the base perimeter, said stacking body having a perimeter adapted to be slightly smaller than the triangular body of said clothes hanger so as to allow a plurality of said clothes hanger to be stacked thereover, said stacking body having a generally triangular shape including three substantially planar side walls, each side wall formed from a continuously flat surface, said side walls meeting at three side edges thereof, each of said three side edges being slightly angled outwardly from top to bottom so as to enable a plurality of said carrying devices to be placed in nesting relation.

2. A carrying device as set forth in claim 1, further comprising a top wall having an integrally formed handle extending upwardly therefrom for easy and convenient transportation of said carrying device.

3. A carrying device as set forth in claim 2, wherein said device is molded from a lightweight plastic material.

4. A carrying device as set forth in claim 1 wherein said base flange extends outwardly from said stacking body by at least one inch.

5. A carrying device as set forth in claim 4 wherein the height of said stacking body is approximately 8½ inches.

6. A carrying device as set forth in claim 1 wherein said stacking body is hollow.

* * * * *